US009287072B2

(12) United States Patent
Mattlar et al.

(10) Patent No.: US 9,287,072 B2
(45) Date of Patent: Mar. 15, 2016

(54) ELECTRIC CURRENT SWITCHING APPARATUS

(71) Applicant: ABB OY, Helsinki (FI)

(72) Inventors: Harri Mattlar, iskmo (FI); Mikko Välivainio, Vaaasa (FI)

(73) Assignee: ABB OY, Helsinki (FI)

( * ) Notice: Subject to any disclaimer, the term of this patent is extended or adjusted under 35 U.S.C. 154(b) by 0 days.

(21) Appl. No.: 14/512,188

(22) Filed: Oct. 10, 2014

(65) Prior Publication Data

US 2015/0041438 A1 Feb. 12, 2015

Related U.S. Application Data

(63) Continuation of application No. PCT/FI2013/050385, filed on Apr. 8, 2013.

(30) Foreign Application Priority Data

Apr. 12, 2012 (EP) ..... 12163951

(51) Int. Cl.

| | |
|---|---|
| ***H01H 33/12*** | (2006.01) |
| ***H01H 1/20*** | (2006.01) |
| ***H01H 71/02*** | (2006.01) |
| ***H01H 71/08*** | (2006.01) |
| ***H01H 73/04*** | (2006.01) |

(52) U.S. Cl.

CPC ..... *H01H 33/12* (2013.01); *H01H 1/2041* (2013.01); *H01H 71/0214* (2013.01); *H01H 71/08* (2013.01); *H01H 73/045* (2013.01)

(58) Field of Classification Search

CPC ..... H01H 9/02; H01H 9/46; H01H 33/10; H01H 33/12; H01H 11/04; H01H 1/20

USPC ..... 218/16, 48, 146, 107, 155, 154; 200/243, 244, 284; 335/185, 201, 202

See application file for complete search history.

(56) References Cited

U.S. PATENT DOCUMENTS

| | | | |
|---|---|---|---|
| 2,749,410 | A | 6/1956 | Weston |
| 4,247,746 | A | 1/1981 | Kidd |

(Continued)

FOREIGN PATENT DOCUMENTS

| | | | |
|---|---|---|---|
| EP | 0 061 020 | A1 | 9/1982 |
| EP | 0 874 380 | A1 | 10/1998 |
| WO | WO 92/00598 | A1 | 1/1992 |

OTHER PUBLICATIONS

International Search Report (PCT/ISA/210) mailed on May 16, 2013, by the Finnish Patent Office as the International Searching Authority for International Application No. PCT/FI2013/050385.

(Continued)

*Primary Examiner* — Renee S Luebke
*Assistant Examiner* — William Bolton
(74) *Attorney, Agent, or Firm* — Buchanan Ingersoll & Rooney PC

(57) ABSTRACT

An electric switch is disclosed which includes a housing module housing a movable contact and a stationary contact having a contact portion to be contacted by the movable contact. The stationary contact can include a mounting portion, which mounting portion can be positioned closer to the center of the housing module than the contact portion of the stationary contact.

20 Claims, 4 Drawing Sheets

(56) References Cited

U.S. PATENT DOCUMENTS

| | | | | |
|---|---|---|---|---|
| 4,451,718 | A | 5/1984 | Yamagata et al. | |
| 4,654,491 | A * | 3/1987 | Maier | H01H 9/46 218/33 |
| 4,910,485 | A | 3/1990 | Bolongeat-Mobleu et al. | |
| 6,518,530 | B2 | 2/2003 | Heins et al. | |
| 6,639,168 | B1 | 10/2003 | Castonguay et al. | |
| 6,924,445 | B2 * | 8/2005 | Bresciani | H01H 77/104 200/244 |
| 7,679,018 | B2 | 3/2010 | Kolmonen et al. | |
| 7,728,247 | B2 | 6/2010 | Pikkala et al. | |
| 2002/0056705 | A1 | 5/2002 | Heins et al. | |
| 2002/0117477 | A1 * | 8/2002 | Douville | H01H 1/2058 218/156 |
| 2004/0227603 | A1 * | 11/2004 | Ciarcia | H01H 77/108 335/202 |
| 2004/0239458 | A1 * | 12/2004 | Harmon | H01H 77/02 335/174 |
| 2007/0145016 | A1 | 6/2007 | Pikkala et al. | |
| 2008/0035464 | A1 | 2/2008 | Kolmonen et al. | |

OTHER PUBLICATIONS

International Search Report (PCT/ISA/210) mailed on Jun. 18, 2013, by the Finnish Patent Office as the International Searching Authority for International Application No. PCT/FI2013/050384.

International Search Report (PCT/ISA/210) mailed on Jun. 17, 2013, by the Finnish Patent Office as the International Searching Authority for International Application No. PCT/FI2013/050383.

* cited by examiner

ELECTRIC CURRENT SWITCHING APPARATUS

RELATED APPLICATIONS

This application claims priority as a continuation application under 35 U.S.C. §120 to PCT/EP2013/050385, which was filed as an International Application on Apr. 8, 2013 designating the U.S., and which claims priority to European Application 12163951.2 filed in Europe on Apr. 12, 2012. The entire contents of these applications are hereby incorporated by reference in their entireties.

FIELD

The present disclosure relates to an electric current switching apparatus.

BACKGROUND INFORMATION

In a switch, having a roll-shaped actuator, the moving contacts can be placed such that they go through the actuator. When the moving contact is opened from a stationary contact, the shortest opening gap, defining a propagation path for an arc may go along the surface of the actuator.

To address this issue, the body of the switch pole may be lengthened such that an arc is formed away from the actuator to avoid erosive effects thereon. One way to implement this is to lengthen the movable contact, and use a knife-like elongate form. Additionally, the stationary contact may be placed such that it resides within the switch as little as possible.

However, mounting of cables to the stationary contact can cause stress thereon and may damage the stationary contact deteriorating the switching performance.

SUMMARY

An electric switch is disclosed, comprising: a housing module housing a rotary contact rotatable by a rotary contacts actuator; a stationary contact formed as an elongate structure having a contact portion to be contacted by the rotary contact and a connection portion for providing an external connection of the stationary contact, the stationary contact having a mounting portion for supporting the stationary contact to the housing module, and the contact portion being arranged between the connection portion and the mounting portion; and a receptacle of the housing module for receiving the mounting portion of the stationary contact, wherein the mounting portion is positioned closer to a centre of the housing module than the contact portion of the stationary contact, the rotary contact actuator including a stoppage element which is arranged to stop rotation of the rotary contact actuator at the receptacle of the mounting portion when the rotary contact is opened.

BRIEF DESCRIPTION OF THE DRAWINGS

In the following, disclosed features will be described in greater detail by way of exemplary embodiments, with reference to the accompanying drawings, in which.

DETAILED DESCRIPTION

A switch is disclosed which can alleviate issues already discussed.

An exemplary electric switch is disclosed for switching electric current. The application areas of the switch include electric motors and solar systems, for instance.

In an exemplary switch according to the disclosure there is provided a stationary contact and a movable contact to be contacted with the stationary contact. The stationary contact can include a contact portion for contacting to the movable contact, and a mounting portion for supporting the stationary contact to the switch module housing. The mounting portion is placed closer to the centre of the switch module than the contact portion.

There may be provided protection and support for the mounting portion. The support may be provided by having one or more wall sections in the switch. In an exemplary embodiment, the support/protection is provided by having a receptacle for receiving the mounting portion of the stationary contact.

This arrangement implies that no compromises need to be done in view of achieving a long opening distance between the contacts. The stationary contact can be formed accordingly such that the contact portion lies between the mounting portion and a connection portion used for connecting the stationary contact externally.

To maximize the switching efficiency, a switch having one or more poles may be provided. Each pole can include stationary contact(s) and a rotary contact connectable with the stationary contact(s). The poles may be connected with cables or shorting members which connect the stationary contacts of the neighbouring poles together.

Figure 1:
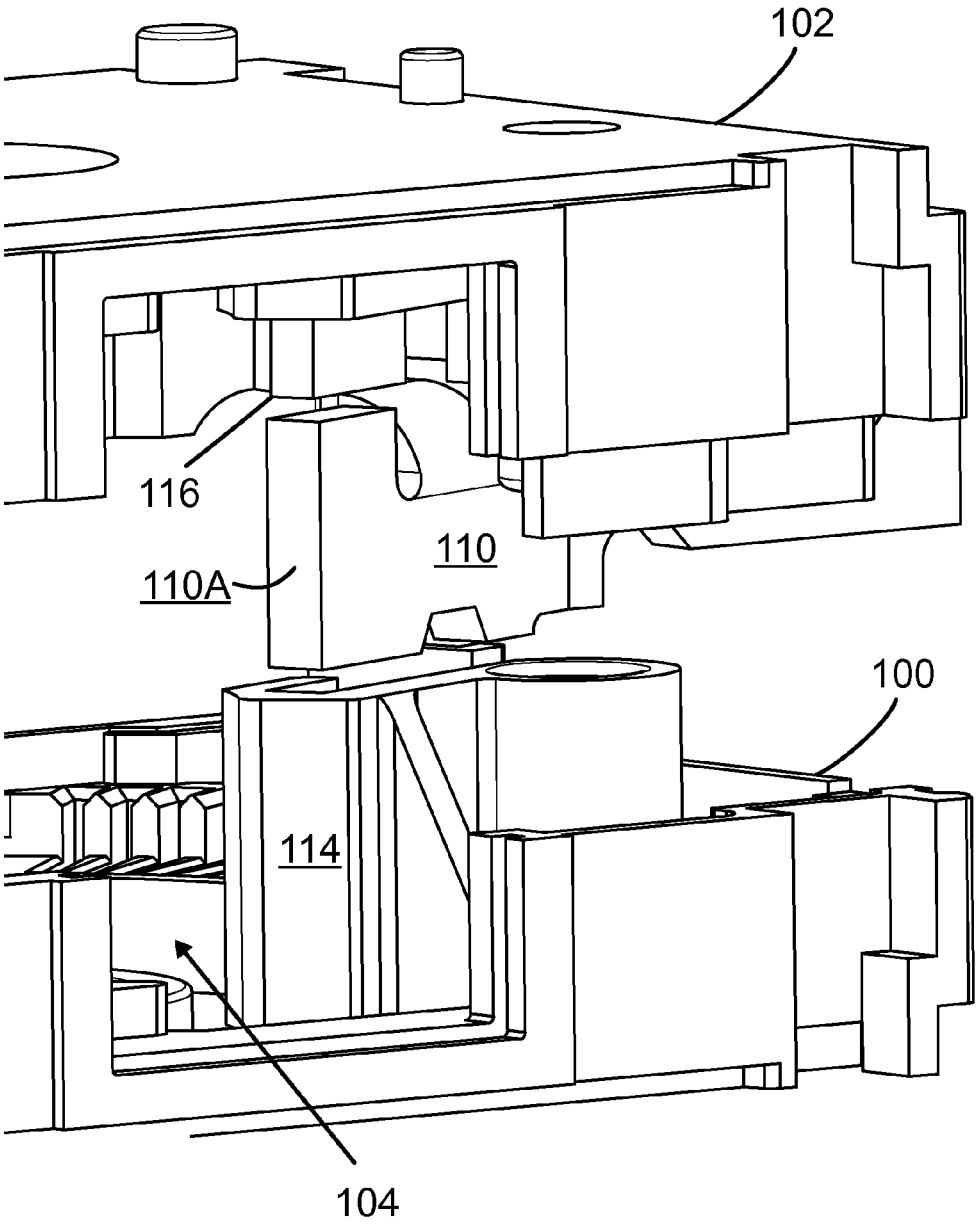
FIG. 1 shows a view of an exemplary embodiment of a switch module.

FIG. 1 shows some of the elements of a pole/module of an exemplary switch. The pole has a bottom module housing 100, and a top module housing 102, which are mountable together to form one pole of the switch. There is provided a contact area 104, where the rotary contact and the stationary contact are contacted and separated from each other.

The stationary contact 110 is shown in FIG. 1 before mounting to the bottom housing 100. The bottom housing 100 can include a receptacle 114 for receiving a mounting portion 110A of the stationary contact. The receptacle provides support for and protects the stationary contact from one or more directions. Firstly, the receptacle includes a bottom wall, against which the stationary contact is placed. Furthermore, the receptacle may provide support for the stationary contact from one or more directions, such as from left, end and right.

FIG. 1 also shows a support element 116 of the top housing, which supports the stationary contact from top when the housings are assembled together and the stationary contact is placed into the receptacle. In an embodiment, the dimensions of the support element 116 are such that it also fits into receptacle and fills the part of the receptacle 114, which is not filled by the mounting portion 110A of the stationary contact 110. Thereby when the top and bottom housings are assembled together, the stationary contact is pressed and supported tightly in the receptacle.

Figure 2:
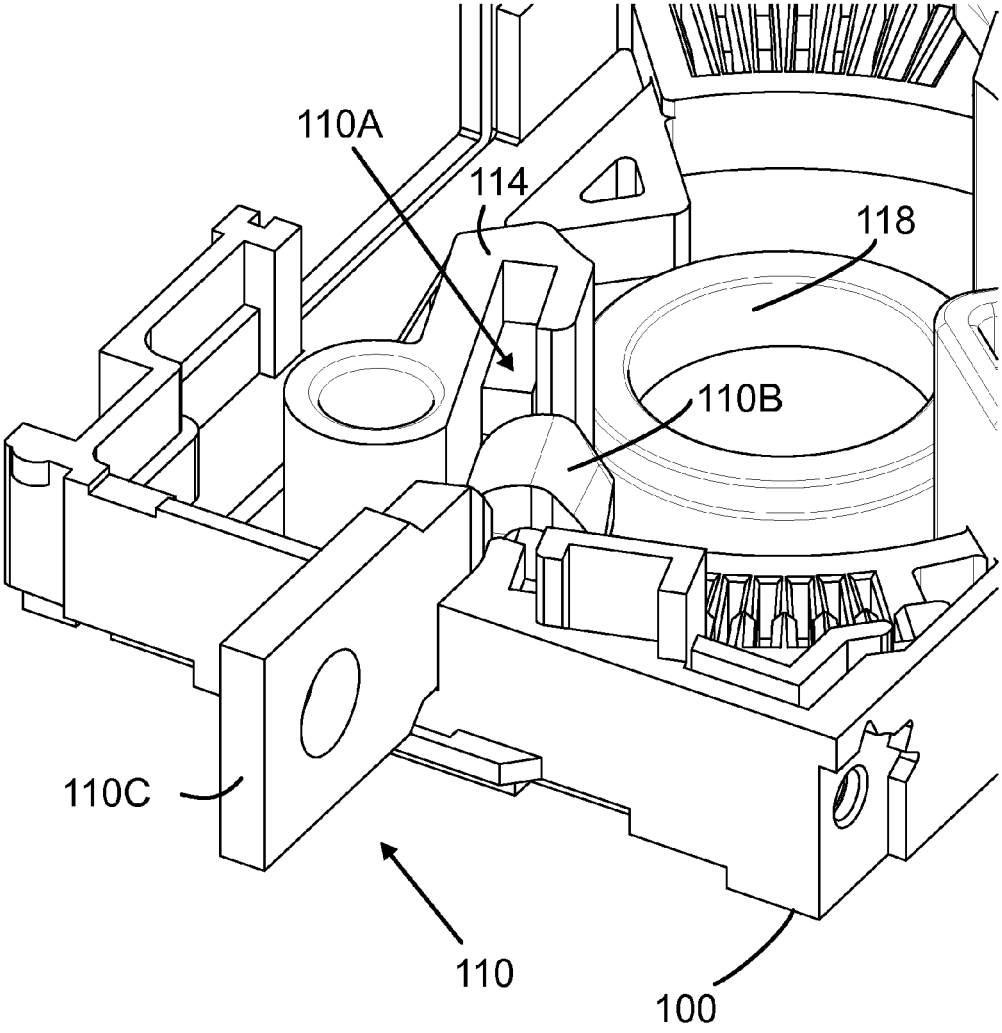
FIG. 2 shows another view of an exemplary embodiment of a switch module.

FIG. 2 shows an exemplary situation where the stationary contact is placed into the receptacle of the bottom housing.

It can be seen that a great part, that is, a connection portion 110C, of the stationary contact resides outside of the switch bottom housing 100. The connection portion can include a hole 110D for receiving a bolt and nut used in fastening of a cable to the connection portion of the stationary contact. As the connection portion 110C and the hole 110D are placed relatively far outside of the housing 100, a strong torque is produced to the stationary contact 110 when the cable is attached to the connection portion 110C of the stationary contact.

The stationary contact 110 also can include a contact portion 110B, which is placed as close as possible to the end of the housing, where the stationary contact exits the housing, to achieve as long opening distances between the contacts as possible. Thereby an arc caused by separating the contacts is induced far away from an actuator of the switch, such that the arc propagation along the actuator can be avoided.

FIG. 2 also shows the mounting portion 110A of the stationary contact 110. The mounting portion has been placed into the receptacle 114 which is adapted to receive the mounting portion with tight fitting. In an exemplary embodiment, the mounting portion 110A has substantially a rectangular shape.

It can be seen from FIG. 2 that the mounting portion 110A fills the receptacle only in part such that the rest of the receptacle can be filled by the support portion of the top cover of the pole housing. When the housing modules are assembled together, the mounting portion becomes fully covered and surrounded by insulating material provided by the receptacle 114 and the support portion of the second housing module. Thereby there is no risk that the arc would propagate towards the mounting portion 110A.

FIG. 2 also shows a housing for an actuator 118 or rotary contact to be contacted by the contact portion 110B of the stationary contact. It can be seen that the mounting portion 110A is tilted to an angle with respect to the contact portion 110B and/or the connection portion 110C. The effect with the tilting is that the mounting portion 110A can be placed aside from and next to the housing for the rotary contact 118. The connection portion 110C and/or the contact portion 110B may point substantially towards the rotary contact housing 118.

It can be seen that the stationary contact 110 can be constructed such that the connection portion 110B lies between the mounting portion 110A and the contact portion 110C. In this way the contact portion 110B can be placed close to the edge of the housing where the stationary contact exits the housing to maximize the opening distance formed between the contacts.

The receptacle for the mounting portion can protect the mounting portion 110A from bending during the mounting of the cable contacts to the connection portion 110C. Furthermore, the receptacle can provide support for the contact portion 110B such that the contact portion is kept tightly in its place during connecting and disconnecting of the contacts, thereby providing security for success of the switching event.

Figure 3:
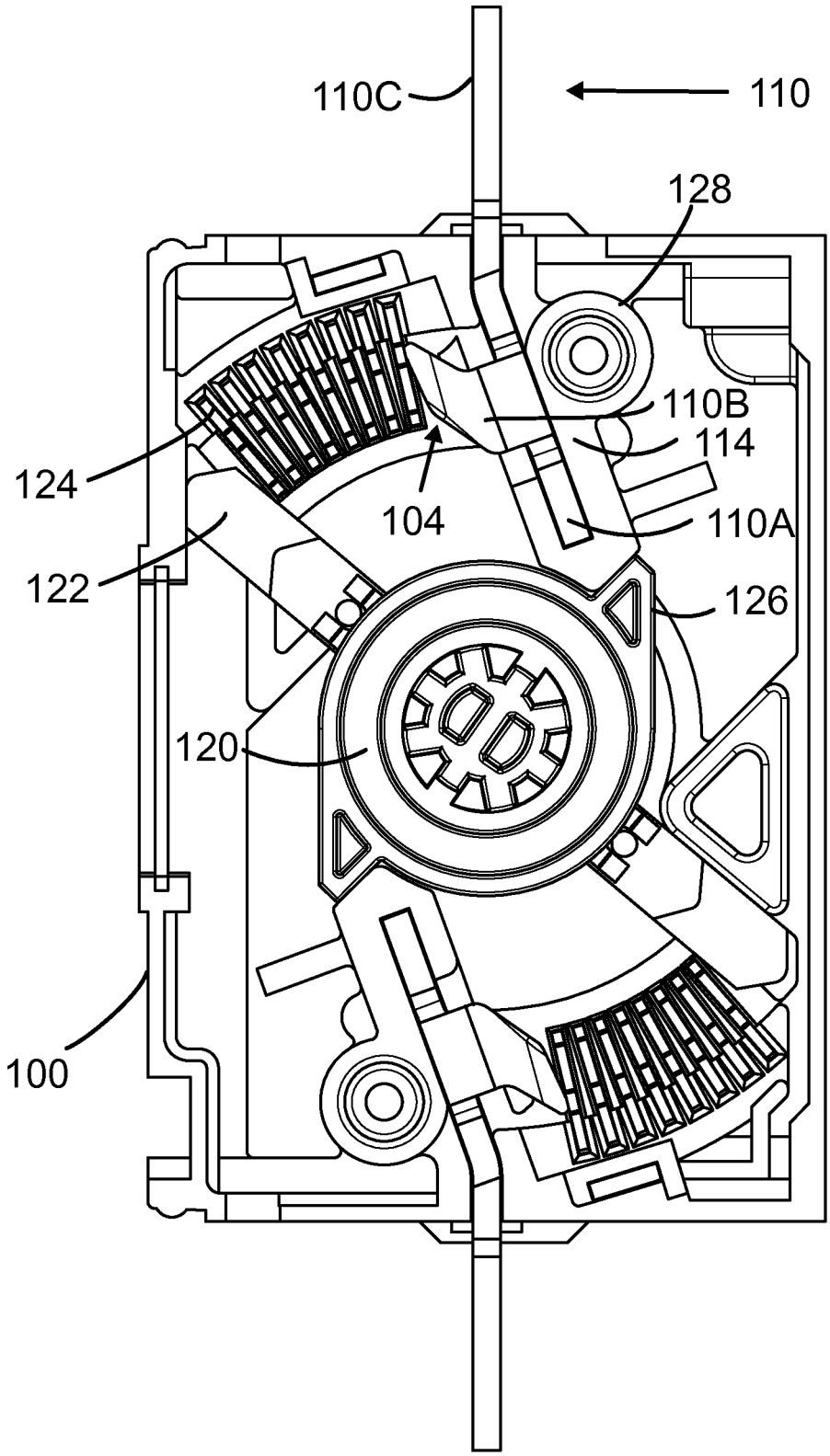
FIG. 3 shows an exemplary embodiment of a switch module seen from the top.

FIG. 3 shows an exemplary embodiment of a pole bottom housing 100 equipped with parts of the switch module.

In FIG. 3, the actuator housing is equipped with an actuator 120, which has the rotary contact attached thereto. The rotary contacts are knife-like elongate blades, which pass through the actuator towards both ends of the pole.

The stationary contact's contact portion 110B is to be contacted by the rotary contact 122 blades. The blades may have a sandwich structure having two blades, between which the contact portion 110B is placed when the contact is made at the contact area 104. The switch of FIG. 3 is shown in fully open position when the contact blade 122 is relatively far away from the contact portion 110B.

It can be seen that the exemplary mounting portion 110A is positioned closer to the centre of the switch module 100 than the contact portion 110B. The contact portion 110B may be placed substantially half-way between the outer edge of the actuator 120 and the edge of the switch module. The centre of the switch module may coincide with the rotation axis of the movable/rotary contact actuator 120. As the mounting portion is closer to the module centre than the contact portion 110B, the stationary contact can efficiently be protected from detrimental effects when the stationary contact's connection portion 110C is connected to external cables. That is, the mounting portion can be located far away from the connection portion 110C and an exit slot of the stationary contact from the housing, and thereby provides a great torque against bending of the stationary contact.

There may be provided protection for the mounting portion 110B against an arc building up when the rotary contact blades 122 are separated from the contact portion 110B of the stationary contact. The protection provides protection also in a situation when electrically conductive carbon black is formed to the surface of the actuator. In such a situation an arc might try to burn on the surface of the actuator via the mounting portion. The protection of the mounting portion may be provided by having one or more insulating wall sections around the mounting portion. For example, one such wall section is arranged substantially between the mounting portion and the arc chamber housing the quenching plates 124.

As the figure shows, the contact area 104, and correspondingly a disconnection area having the quenching plates 124 can be located at a distance from the actuator 120. This can avoid the actuator surface from forming a contact bridge for the arc. In some cases, a disadvantage of moving the contact area far away from the actuator, is that the contact portion 110B practically resides fairly close to the edge of the switch housing. Fastening of external contacts to the connection portion 110C may cause twisting of the stationary contact 110.

The exemplary embodiment of FIG. 3 addresses such an issue by providing a receptacle 114 for receiving a mounting portion 110A of the stationary contact. The stationary contact is supported at least from two points, by the receptacle 114, and an exit hole in the housing 100 at the point where the stationary contact exits the housing. The mounting portion 110A can be housed by the receptacle from the bottom and three sides, and a support portion of the top cover may fill the rest of the receptacle. Thus, the mounting portion can be fully covered, and as the receptacle and the support portion can be made of electrically insulating material, the mounting portion is electrically insulated and there is no risk that the mounting portion 110A would function as a contact bridge.

FIG. 3 shows also a stoppage element 126 of the actuator 120. It can be seen that the actuator has a round cylindrical base portion, and one or more stoppage elements are arranged as wings projecting from the cylindrical base portion. The side of the stoppage element, which faces the opening direction, may project substantially perpendicularly from the cylindrical base portion. In FIG. 3, there are two stoppage elements 126 on opposite sides of the cylindrical base portion of the actuator.

The stoppage element may be a molded and integral part of the actuator. When the contact is opened, springs or other force-transmitting elements may be used such that the contact is opened as rapidly as possible. The rapid opening of the switch can set high requirements for stopping the opening rotation of the actuator. In the exemplary embodiment of FIG. 3, the receptacle is arranged such that is works as a stoppage support for the stoppage element 126 of the actuator. It can be seen that when the actuator is in its open position, the stoppage element has a wall section which sets against a parallel wall section of the receptacle.

FIG. 3 shows an exemplary through hole housing 128 for receiving a bolt which connects and fastens the bottom housing and top housing of one or more poles together. As can be seen, the through hole housing is positioned behind the receptacle such as to further provide support for the receptacle against forces caused by the stoppage element 126 due to the opening of the contacts.

As can be seen, the stationary contact can be tilted from a point inside the housing 100 that is close to the edge of the housing. The stationary contact can have an elongate base structure, which is arranged to an angle with respect to the connection portion 110C. Thereby the total length of the stationary contact within the module can be maximized, thereby maximizing the support provided by the receptacle.

The contact portion 110B can be arranged between the connection portion 110C and the mounting portion 110A. The contact portion may be arranged as a projection projecting substantially perpendicularly from the base structure of the stationary contact. The contact portion may include a base portion projecting from the base of the stationary contact, and a wing-like section arranged to an angle from the base portion of the contact portion.

In the exemplary embodiment of FIG. 3, the stationary contact thus has in an elongate direction two portions, the connection portion 110C and the base portion tilted from the connection portion. The mounting portion 110A and the contact portion can be arranged onto the same elongate base portion structure. The mounting portion can be seen as an extension of the stationary contact towards the interior of the switch module.

Figure 4A:
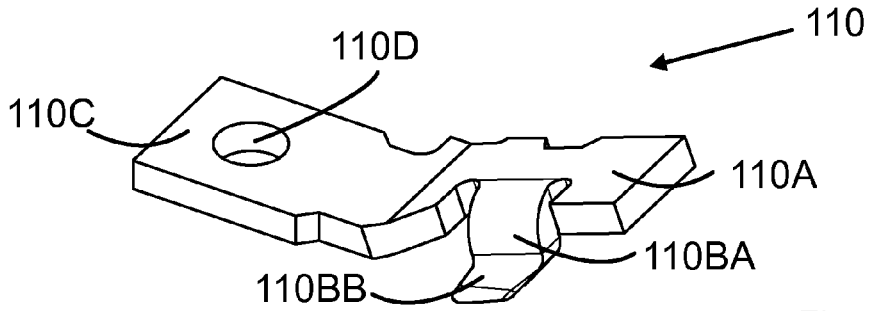
FIGS. 4A to 4C show an exemplary embodiment of a stationary contact from three different viewing angles.
Figure 4B:
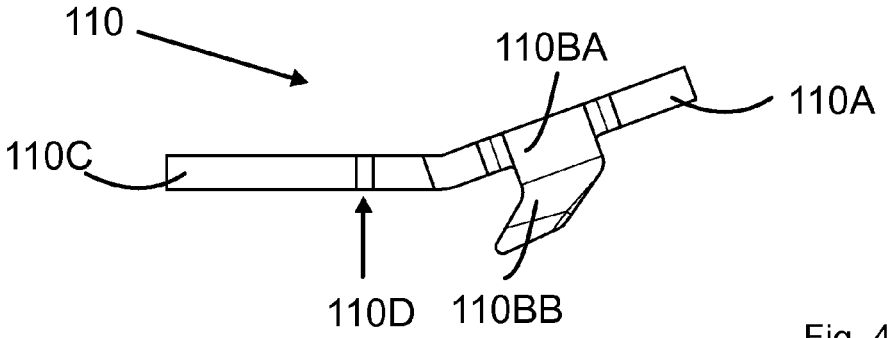
Figure 4C:
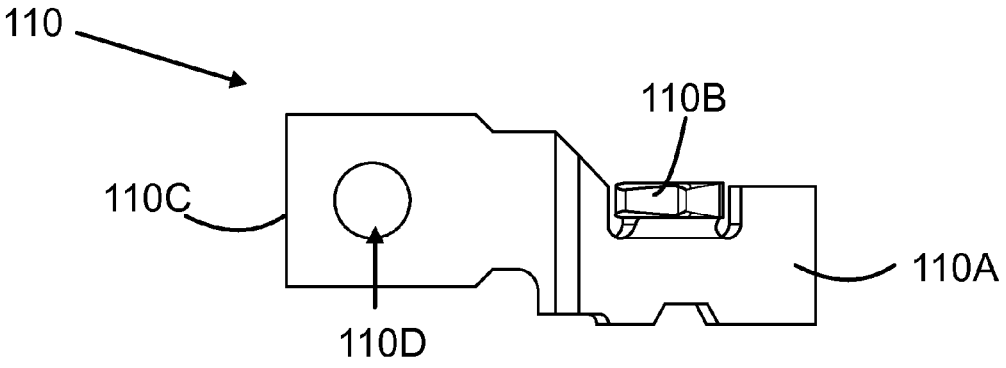

FIGS. 4A to 4C show an exemplary embodiment of the stationary contact 110 seen from different directions.

FIG. 4A highlights an elongate structure of the stationary contact 110. As can be seen, the contact portion lies between the mounting portion 110A and the connection portion 110C in the longitudinal direction of the contact 110. The contact portion can include a base portion 100BA, which connects the contact portion to the elongate body of the stationary contact. The base portion may be arranged as a projection substantially perpendicularly with respect to the body of the stationary contact, and the mounting portion can be arranged as an extension of the stationary contact from the point where the contact portion projects from the stationary contact. The contact portion may also include an actuating portion 100BB, which practically actuates the contact with the rotary contact.

FIG. 4B highlights examples of different angles in the stationary contact. By way of an example, the angle between the connection portion 110C and the rest of the base body of the stationary contact may be about 15 degrees, for instance. In other exemplary embodiments, the angle may reside between 5 to 45 degrees, for instance. In the contact portion, the angle between the base portion 110BA and the actuating portion 110BB may be about 45 degrees, for instance. FIG. 4B also shows that the length of the connection portion 110C, most of which lies outside of the housing when mounted, can be approximately half of the total body length of the stationary contact 110.

FIG. 4C shows the stationary contact from behind, where it can be seen that the mounting portion 100A sets a little lower than the connection portion 110C. It will be apparent to those skilled in the art that, as the technology advances, the inventive concept can be implemented in various ways. The invention and its embodiments are not limited to the examples described herein but may vary within the scope of the claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. An electric switch, comprising:

a housing module housing a rotary contact rotatable by a rotary contacts actuator;

a stationary contact formed as an elongate structure having a contact portion to be contacted by the rotary contact and a connection portion for providing an external connection of the stationary contact, the stationary contact having a mounting portion for supporting the stationary contact to the housing module, and the contact portion being arranged between the connection portion and the mounting portion; and a receptacle of the housing module for receiving the mounting portion of the stationary contact, wherein the mounting portion is positioned closer to a centre of the housing module than the contact portion of the stationary contact, the rotary contact actuator including a stoppage element which is arranged to stop rotation of the rotary contact actuator at the receptacle of the mounting portion when the rotary contact is opened.

2. The electric switch according to claim 1, wherein the module housing comprises:

at least one wall section for protecting the mounting portion from any arc which builds up when the contact portion of the stationary contact and the movable contact are separated from each other.

3. The electric switch according to claim 1, wherein the switch housing module comprises:

a first housing module housing the rotary contact and the stationary contact to be contacted by the rotary contact; and a second housing module to be assembled together with the first housing module, wherein the first housing module includes the receptacle for receiving a mounting portion of the stationary contact, and the second housing module includes the support element for supporting the mounting portion of the stationary contact positioned at the receptacle when the first housing module and the second housing module are assembled together.

4. The electric switch according to claim 1, wherein the mounting portion of the stationary contact is arranged to fill the receptacle only in part, and the rest of the receptacle is to be filled by the support element of the second housing module.

5. The electric switch according to claim 1, wherein the receptacle is arranged to support and to protect the mounting portion of the stationary contact from the bottom, and at least from one side.

6. The electric switch according to claim 1, wherein the stationary contact has an elongate base structure, and comprises:

a contact portion for connecting the stationary contact to the rotary contact, wherein the contact portion is arranged as a projection projecting from the base structure of the stationary contact.

7. The electric switch according to claim 1, wherein the first housing module comprises:

on its edge, an exit slot for supporting the stationary contact, and the stationary contact includes a contact portion for connecting the stationary contact to the rotary contact, and the mounting portion supporting the stationary contact to the housing, which mounting portion is arranged as an extension of the stationary contact behind the contact portion when viewed from the exit slot.

8. The electric switch according to claim 1, wherein the stationary contact comprises:

a connection portion for contacting the stationary contact externally, and a base portion including the mounting portion and the projection of the contact portion, and the connection portion is tilted to an angle with respect to the base portion.

9. The electric switch according to claim 1, wherein substantially a half of a length of the stationary contact lies outside of the housing.

10. The electric switch according to claim 1, wherein the receptacle comprises:

a rectangular portion adapted to receive a rectangular mounting portion of the stationary contact and/or a rectangular support portion of the second module.

11. The electric switch according to claim 1, wherein the rotary contact actuator and the receptacle each comprises:

wall sections which are parallel to each other when the actuator is in the open position.

12. The electric switch according to claim 2, wherein the switch housing module comprises:

a first housing module housing the rotary contact and the stationary contact to be contacted by the rotary contact; and a second housing module to be assembled together with the first housing module, wherein the first housing module includes the receptacle for receiving a mounting portion of the stationary contact, and the second housing module includes the support element for supporting the mounting portion of the stationary contact positioned at the receptacle when the first housing module and the second housing module are assembled together.

13. The electric switch according to claim 12, wherein the mounting portion of the stationary contact is arranged to fill the receptacle only in part, and the rest of the receptacle is to be filled by the support element of the second housing module.

14. The electric switch according to claim 13, wherein the receptacle is arranged to support and to protect the mounting portion of the stationary contact from the bottom, and at least from one side.

15. The electric switch according to claim 14, wherein the stationary contact has an elongate base structure, and comprises:

a contact portion for connecting the stationary contact to the rotary contact, wherein the contact portion is arranged as a projection projecting from the base structure of the stationary contact.

16. The electric switch according to claim 15, wherein the first housing module comprises:

on its edge, an exit slot for supporting the stationary contact, and the stationary contact includes a contact portion for connecting the stationary contact to the rotary contact, and the mounting portion supporting the stationary contact to the housing, which mounting portion is arranged as an extension of the stationary contact behind the contact portion when viewed from the exit slot.

17. The electric switch according to claim 16, wherein the stationary contact comprises:

a connection portion for contacting the stationary contact externally, and a base portion including the mounting portion and the projection of the contact portion, and the connection portion is tilted to an angle with respect to the base portion.

18. The electric switch according to claim 17, wherein substantially a half of a length of the stationary contact lies outside of the housing.

19. The electric switch according to claim 18, wherein the receptacle comprises:

a rectangular portion adapted to receive a rectangular mounting portion of the stationary contact and/or a rectangular support portion of the second module.

20. The electric switch according to claim 19, wherein the rotary contact actuator and the receptacle each comprises:

wall sections which are parallel to each other when the actuator is in the open position.

* * * * *